US009574420B2

(12) United States Patent
Hall et al.

(10) Patent No.: US 9,574,420 B2
(45) Date of Patent: Feb. 21, 2017

(54) WELL INTERVENTION TOOL AND METHOD

(71) Applicant: OneSubsea IP UK Limited, London (GB)

(72) Inventors: Graham Hall, Stonehaven (GB); Robert Large, Aberdeen (GB); James Duncan Trinder, Aberdeenshire (GB)

(73) Assignee: OneSubsea IP UK Limited, London (GB)

( * ) Notice: Subject to any disclaimer, the term of this patent is extended or adjusted under 35 U.S.C. 154(b) by 172 days.

(21) Appl. No.: 14/519,550

(22) Filed: Oct. 21, 2014

(65) Prior Publication Data

US 2015/0136409 A1 May 21, 2015

Related U.S. Application Data

(60) Provisional application No. 61/893,566, filed on Oct. 21, 2013.

(51) Int. Cl.

| | |
|---|---|
| ***E21B 33/035*** | (2006.01) |
| ***E21B 33/076*** | (2006.01) |
| ***E21B 34/04*** | (2006.01) |
| ***E21B 17/20*** | (2006.01) |
| ***E21B 43/16*** | (2006.01) |
| ***E21B 41/04*** | (2006.01) |
| ***E21B 43/017*** | (2006.01) |

(52) U.S. Cl.

CPC ..... *E21B 34/04* (2013.01); *E21B 17/20* (2013.01); *E21B 33/0355* (2013.01); *E21B 41/04* (2013.01); *E21B 43/017* (2013.01); *E21B 43/16* (2013.01)

(58) Field of Classification Search

CPC .... E21B 17/20; E21B 33/0355; E21B 33/076; E21B 34/04; E21B 41/04; E21B 43/017; E21B 43/16

See application file for complete search history.

(56) References Cited

U.S. PATENT DOCUMENTS

| | | | | |
|---|---|---|---|---|
| 6,435,279 | B1 * | 8/2002 | Howe | E21B 49/086 166/336 |
| 6,840,088 | B2 * | 1/2005 | Tucker | F16L 1/26 73/49.5 |
| 7,137,450 | B2 * | 11/2006 | Johansen | E21B 33/0355 166/316 |
| 7,159,662 | B2 * | 1/2007 | Johansen | E21B 23/04 166/319 |
| 9,187,980 | B2 * | 11/2015 | McHugh | E21B 33/076 |

(Continued)

OTHER PUBLICATIONS

International Search Report and Written Opinion dated Jan. 28, 2015, issued in corresponding PCT application No. PCT/US2014/061587, filed Oct. 21, 2014, 17 pgs.

*Primary Examiner* — Matthew R Buck
(74) *Attorney, Agent, or Firm* — Chamberlain Hrdlicka

(57) ABSTRACT

A system to control fluid flow through a fluid passage includes a valve that is fail-safe closed to selectively control fluid flow through the fluid passage, and a hydraulic actuator operatively coupled to the valve to open the valve when hydraulic pressure above a predetermined amount is received. The system further includes an inlet to provide hydraulic pressure to the hydraulic actuator and open the valve and an outlet to vent hydraulic pressure from the hydraulic actuator and close the valve.

20 Claims, 3 Drawing Sheets

(56) References Cited

U.S. PATENT DOCUMENTS

| | | | | |
|---|---|---|---|---|
| 9,234,400 | B2 * | 1/2016 | Warnock, Jr. ..... | E21B 33/0355 |
| 2006/0151175 | A1 | 7/2006 | Sundararajan et al. | |
| 2008/0264646 | A1 * | 10/2008 | Sten-Halvorsen .. | E21B 33/0355<br>166/360 |
| 2011/0114329 | A1 * | 5/2011 | Emecheta ..... | E21B 33/0355<br>166/350 |
| 2011/0198092 | A1 * | 8/2011 | Machin ..... | E21B 17/012<br>166/349 |
| 2012/0024531 | A1 | 2/2012 | Suter | |
| 2012/0168169 | A1 * | 7/2012 | Voss ..... | E21B 33/0355<br>166/341 |
| 2012/0318529 | A1 * | 12/2012 | Herrold ..... | E21B 43/01<br>166/375 |
| 2012/0324876 | A1 * | 12/2012 | Fuselier ..... | E21B 33/0355<br>60/327 |
| 2013/0327534 | A1 * | 12/2013 | Christie ..... | E21B 33/0355<br>166/345 |
| 2014/0027123 | A1 * | 1/2014 | Organ ..... | E21B 33/0355<br>166/339 |

* cited by examiner

WELL INTERVENTION TOOL AND METHOD

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

Oil and gas wells frequently require subsurface maintenance and remediation to maintain adequate flow or production. Intervention operations on subsea wells require specialized intervention equipment to pass through the water column and to gain access to the well. The system of valves on the wellhead is commonly referred to as the "tree" and the intervention equipment is attached to the tree with a well access or well intervention package. For example, a well access package may be used for a variety of services, including pumping fluids, such as chemicals, into the well, maintaining and testing the wellhead or the tree, performing slickline type operations, in addition to other types of services and operations.

Accordingly, well intervention may enable various treatment chemicals to be injected into the well, such as to reduce the build-up of substances in production flowlines as the product flows from the well to a topside production facility (e.g. corrosion inhibitors, scale inhibitors, paraffin inhibitors, hydrate inhibitors, and demulsifiers), and also enable operations related to well stimulation, well kill, flow assurance, scale management, in addition to others.

A known method for well intervention involves the use of a remotely operated vehicle (ROV) and a subsea skid. Current state of the art methods require that the well access package and skid be assembled on the surface and then lowered to the seafloor with winches. When the well access package is in the vicinity of the tree, the ROV is used to guide the skid into position and locked to the tree. A control umbilical attached to the skid is then used to operate the various functions required to access the well. The umbilical provides control functions for the well access package and skid, as well as a conduit for various fluids, included chemical treatment fluids, circulated in or through the skid.

Existing skids typically have a direct hydraulic control or multiplexer (MUX) control system to operate valves on the skid. This requires there to be an electrical cable or hydraulic hose from the vessel at surface to the skid subsea. However, with subsea operations only moving to deeper waters and more remote locations, it remains a priority to maintain or increase the functionality of subsea skids and similar equipment while minimizing the burden of support and maintenance for such equipment.

BRIEF DESCRIPTION OF THE DRAWINGS

For a detailed description of the preferred embodiments of the present disclosure, reference will now be made to the accompanying drawings in which.

DETAILED DESCRIPTION

Figure 1:
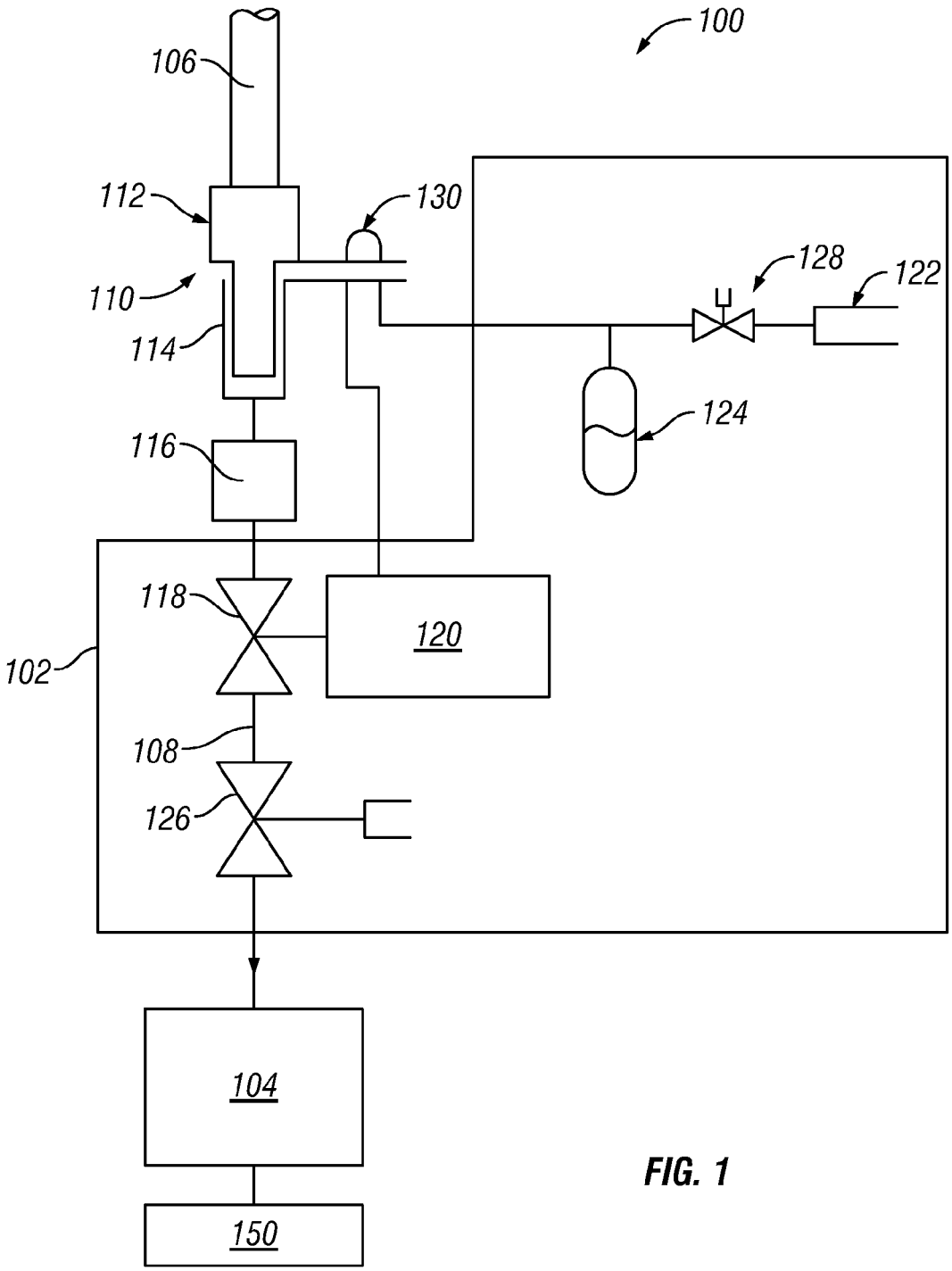
FIG. 1 shows a schematic view of a subsea well service system in accordance with one or more embodiments of the present disclosure.

The following discussion is directed to various embodiments of the present disclosure. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed below may be employed separately or in any suitable combination to produce desired results. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but are the same structure or function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. The use of "top," "bottom," "above," "below," and variations of these terms is made for convenience, but does not require any particular orientation of the components.

Reference throughout this specification to "one embodiment," "an embodiment," or similar language means that a particular feature, structure, or characteristic described in connection with the embodiment may be included in at least one embodiment of the present disclosure. Thus, appearances of the phrases "in one embodiment," "in an embodiment," and similar language throughout this specification may, but do not necessarily, all refer to the same embodiment.

Referring now to FIG. 1, a schematic view of a subsea well service system 100 in accordance with one or more embodiments of the present disclosure is shown. The system 100 may include a subsea skid 102, which may be operatively coupled and/or positioned between a subsea tree 104 or manifold and a surface vessel, such as a derrick, platform, drilling rig, ship, liner, and/or anything other type of floating vessel. For example, the subsea skid 102 may be used to facilitate well intervention techniques through the subsea tree 104 and into a well 150. This may involve injecting fluids, such as chemical fluids for chemical treatment purposes, from a conduit 106 extending from the surface vessel, into and through a fluid passage 108 of the subsea skid 102, and into the well through the subsea tree 104. A chemical treatment and/or fluid injection may be used for applications, such as well stimulation, well kill, flow assurance, scale management, in addition to many other purposes and applications. In addition or in alternative to fluid injection into a well, the subsea skid 102 may be used to inject, introduce, and/or otherwise control fluid flow with respect to one or more flowlines, jumpers, and/or manifolds, such as when subsea. Further, in one or more embodiments, the subsea skid 102 may either be a permanent or a non-permanent installation.

Fluid may be provided from a fluid supply source, such as upon the subsea vessel, through the conduit 106, such as, but not limited to, coiled tubing, composite pipe, flexible pipe, hose, riser, and/or any other type of conduit, and into a weak link coupling 110. The weak link coupling 110 may be used or designed to disconnect and decouple if too much force is received by the weak link coupling 110. The weak link coupling 110, which may be a pressure balanced weak link (PBWL) coupling and/or a subsea connectable coupling, may include a male member 112 receivable within a female member 114 with a fluid passage extending through the male member 112 and the female member 114 to the weak link coupling 110. When the male member 112 and the female member 114 are connected and coupled to each other, fluid may pass through the weak link coupling 110, such as from the conduit 106, through the weak link coupling 110, and into a flexible joint 116. When the male member 112 and the female member 114 are disconnected and decoupled from each other, fluid may be prevented from passing through the weak link coupling 110.

As mentioned, the weak link coupling 110 may be used or designed to disconnect and decouple if too much force is received by the weak link coupling 110. For example, if force above a predetermined amount is received by the weak link coupling 110, such as a tensile force between the male member 112 and the female member 114, then the male member 112 and the female member 114 may disconnect and decouple from each other, such as to prevent damage to the weak link coupling 110 and/or other components of the system 100 (e.g., the conduit 106). An example may include when the surface vessel and/or the subsea skid 102 drifts off-course, thereby tensioning the conduit 106 extending between the surface vessel and the subsea skid 108. The male member 112 and/or the female member 114 may also each seal to prevent any fluid leaking through the weak link coupling 110 upon disconnection or decoupling. In one or more embodiments, the predetermined amount of force to disconnect the coupling 110 may be fixed, or may be variable, in which the force may be adjusted and set as desired or needed.

The flexible joint 116 may also include a fluid passage to communicate fluid between the weak link coupling 110 and the fluid passage 108 of the subsea skid 102. The flex joint 116 may be used and designed to relieve forces or stresses received within the system 100, such as stress (e.g., bending stress) experienced by the subsea skid 102 when deployed, retrieved, or in use subsea. As such, when present, fluid may pass from the weak link coupling 110, through the flexible joint 116, and into the subsea skid 102.

In accordance with one or more embodiments of the present disclosure, the subsea skid 102 may be used to form a barrier between the conduit 106 and the subsea tree 104, such as to selectively control fluid flow between the conduit 106 and the subsea tree 104 (e.g., in both directions, such as upstream and/or downstream) using one or more valves. However, in one or more embodiments, the subsea skid 102 may be able to be controlled without requiring communication from the surface (e.g., the surface vessel). For example, as the subsea skid 102 may include one or more valves, the system 100 may be able to avoid electrical cables, hydraulic hoses, and/or any type of wireless communication (e.g., acoustic signals) to control the valves and/or any other components of the subsea skid 102.

Accordingly, referring still to FIG. 1, the system 100 and/or the subsea skid 102 may include a valve 118, such as an injection swab valve, that may selectively control fluid flow through the fluid passage 108. In one or more embodiments, an injection swab valve may be located above one or more others valves and/or barriers of a bore or flowpath, such as the fluid passage 108. As such, the injection swab valve may be used to provide a barrier when connected the conduit 106 to the fluid passage 108. In one or more embodiments, the valve 118 may be hydraulically actuated using a hydraulic actuator 120 operatively coupled to the valve 118 to open and close the valve 118. Further, the valve 118 may be a fail-safe closed valve such that, in the event that the hydraulic actuator 120 and/or the valve 118 fails (e.g., a hydraulic pressure loss), the valve 118 may then fail in the closed position to prevent fluid flow through the fluid passage 108. As such, when hydraulic pressure is received by the hydraulic actuator 120, such as hydraulic pressure above a predetermined amount, the hydraulic actuator 120 may then actuate the valve 118 to move the valve to the open position and enable fluid flow through the fluid passage 108.

The system 100 and/or the subsea skid 102 may include an inlet 122 and an accumulator 124. The accumulator 124 may be in fluid communication with the hydraulic actuator 120 to accumulate and provide hydraulic pressure to the hydraulic actuator 120. The inlet 122 may be used to receive and provide hydraulic pressure to the subsea skid 102, such as to provide hydraulic pressure to the accumulator 124 and/or the hydraulic actuator 120 to open the valve 118. As such, in one or more embodiments, the inlet 122 may be a hot stab that is operable or connectable with a remotely operated vehicle (ROV), such as when subsea, such that an ROV may connect with the inlet 122 to provide hydraulic pressure to the accumulator 124 and/or the hydraulic actuator 120. The system 100 and/or the subsea skid 102 may include a valve 126, such as a work valve, that may selectively control fluid flow through the fluid passage 108. Further, the system 100 and/or the subsea skid 102 may include a valve 128 in fluid communication between the inlet 122 and the accumulator 124 to selectively control the flow of hydraulic pressure therebetween. As shown, the valve 126 and/or the valve 128 may be controllable by an ROV. In one or more embodiments, the valve 118 may additionally or alternatively be controllable by an ROV. In one or more embodiments, one or more of the valves in the system, such as identified above, may additionally or alternatively be controllable from the surface, such as by remotely controlled (e.g., wireless) and/or through the use of direct control (e.g., cable).

Referring still to FIG. 1, the system 100 may include a hydraulic fuse 130. The hydraulic fuse 130 may be a hydraulic coupling, such as a quick connect-disconnect coupling and/or any other type of hydraulic fuse, which may include a male member and a female member connectable with each other. When the hydraulic fuse 130 is then disconnected, such as the male member and the female member are disconnected from each other, the hydraulic fuse 130 may be able to vent or leak hydraulic pressure through the hydraulic fuse 130. As shown, the hydraulic fuse 130 may be in fluid communication with the hydraulic actuator 120 and/or the accumulator 124. As such, the hydraulic fuse 130 may be able to vent hydraulic pressure from the hydraulic actuator 120 and/or the accumulator 124 when disconnected. In such an embodiment, this may enable the valve 118 to close and prevent fluid flow through the fluid passage 108, as the valve 118 may be fail-safe closed and insufficient hydraulic pressure may be within the system 100 and/or the subsea skid 102 to enable the hydraulic actuator 120 to open the valve 118.

The hydraulic fuse 130 may be connected to and/or operatively coupled to the weak link coupling 110 such that, when the weak link coupling 110 disconnects, then the hydraulic fuse 130 may disconnect as well. For example, in the event that a force is received by the weak link coupling 110 large enough to disconnect the male member 112 from the female member 114, then the members of the hydraulic fuse 130 may also disconnect. When the hydraulic fuse 130 disconnects, along with the weak link coupling 110, this may close the valve 118, thereby preventing fluid flow through the fluid passage 108 and potentially spilling out into the environment subsea. Accordingly, in one or more embodiments, the valve 118 may be independently controllable without any communication from the surface, such as to close the valve 118 in the loss of hydraulic pressure, even though the valve 118 may also be additionally controlled from the surface, such as for purposes of redundancy or separate control.

Figure 2:
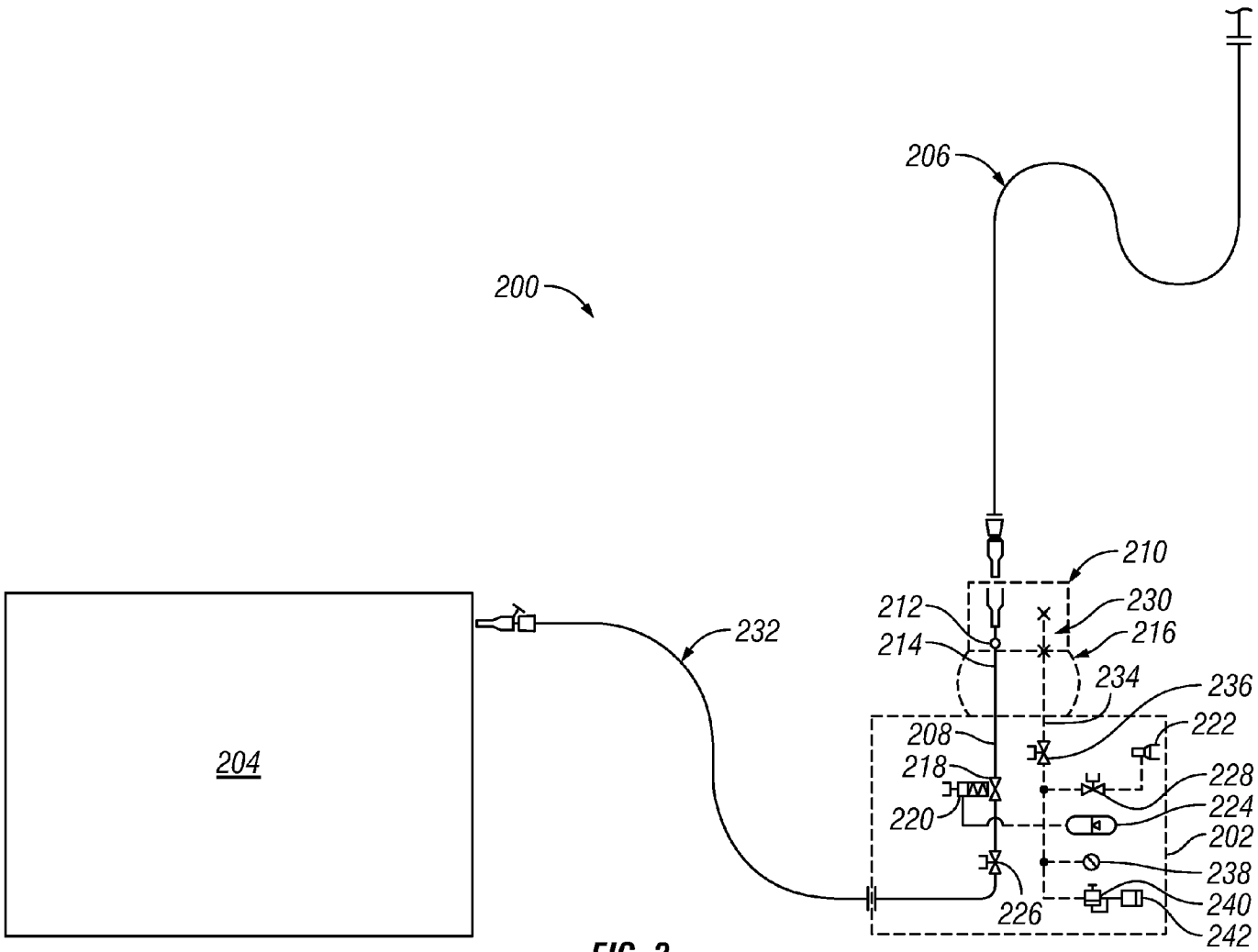
FIG. 2 shows a schematic view of a subsea well service system in accordance with one or more embodiments of the present disclosure.

Referring now to FIG. 2, a schematic view of a subsea well service system 200 in accordance with one or more embodiments of the present disclosure is shown. The system 200 may be similar to the system 100 shown in FIG. 1, and may include a subsea skid 202 operatively coupled and/or positioned between a surface vessel and a subsea tree 204, manifold, and/or other subsea component. As such, a conduit 206 may extend from the surface vessel, into and through a fluid passage 208 of the subsea skid 202, and into a well through the subsea tree 204. Further, as shown, another conduit 232, such as a flexible jumper and/or any other type of conduit, may be used to fluidly couple the fluid passage 208 of the subsea skid 202 to the subsea tree 204.

Fluid provided from the subsea vessel, through the conduit 206, may flow through a weak link coupling 210 and a flexible joint 216, and into the subsea skid 202. As discussed above, the weak link coupling 210 may include a male member 212 receivable within a female member 214 with a fluid passage extending therethrough. Fluid may pass through the weak link coupling 210 when the male member 212 and the female member 214 are connected and coupled to each other. Fluid may be prevented from passing through the weak link coupling 210 when the male member 212 and the female member 214 are disconnected and decoupled from each other.

As discussed above, the subsea skid 202 may be used to form a barrier between the conduit 206 and the subsea tree 204, such as by including one or more valves to selectively control fluid flow between the conduit 206 and the subsea tree 204. As such, the system 200 and/or the subsea skid 202 may include a valve 218 that may selectively control fluid flow through the fluid passage 208. The valve 218 may be hydraulically actuated using a hydraulic actuator 220 operatively coupled to the valve 218 to open and close the valve 218. Further, the valve 218 may be a fail-safe closed valve, such as biased towards the closed position, such that the valve 218 closes upon failure of or pressure loss within the hydraulic actuator 220 and/or the valve 218. The hydraulic actuator 220 may then actuate the valve 218 to move the valve to the open position and enable fluid flow through the fluid passage 208 when hydraulic pressure above a predetermined amount is received by the hydraulic actuator 120.

In this embodiment, the system 200 and/or the subsea skid 202 may include an inlet 222, an outlet 234, and/or an accumulator 224. The accumulator 224 may be in fluid communication between the inlet 222 and the hydraulic actuator 220 to accumulate and provide hydraulic pressure to the hydraulic actuator 220. The inlet 222 may be used to receive and provide hydraulic pressure to the subsea skid 202, such as to provide hydraulic pressure to the accumulator 224 and/or the hydraulic actuator 220 to open the valve 218. The outlet 234 may be used to vent hydraulic pressure from the hydraulic actuator 220 and/or the accumulator 224, such as to close the valve 218.

The system 200 and/or the subsea skid 202 may include a valve 226, such as a work valve, that may selectively control fluid flow through the fluid passage 208. Further, the system 200 and/or the subsea skid 202 may include a valve 228 in fluid communication between the inlet 222 and the accumulator 224 and/or the hydraulic actuator 220 to selectively control the flow of hydraulic pressure therebetween. Furthermore, the system 200 and/or the subsea skid 202 may include a valve 236 in fluid communication between the outlet 234 and the accumulator 224 and/or the hydraulic actuator 220 to selectively control the flow of hydraulic pressure therebetween. As shown, the valve 218, the valve 226, the valve 228, and/or the valve 236 may be controllable by an ROV.

Referring still to FIG. 2, the system 200 and/or the subsea skid 202 may include a pressure gauge 238, a pressure relief valve 240, and/or a pressure compensator 242. The pressure gauge 238 may be in fluid communication with the hydraulic actuator 220 to measure hydraulic pressure provided to the hydraulic actuator 220. The pressure relief valve 240 may be in fluid communication with hydraulic actuator 220 to relieve hydraulic pressure above a predetermined amount, such as to protect the hydraulic actuator 220 from damage. Further, the pressure compensator 242 may be in fluid communication with the pressure relief valve 240 and/or the hydraulic actuator 220 to compensate and regulate hydraulic pressure provided within the subsea skid 202.

As discussed above, the system 200 may include a hydraulic fuse 230 in fluid communication with the outlet 234. The hydraulic fuse 230 may be a hydraulic coupling, such as a quick connect-disconnect coupling and/or any other type of hydraulic fuse, which may include a male member and a female member connectable with each other. When the hydraulic fuse 130 is disconnected, the hydraulic fuse 230 may be able to vent or leak hydraulic pressure from the hydraulic actuator 220 and/or the accumulator 224, through the outlet 234, and out through the hydraulic fuse 230, thereby enabling the valve 218 to close and prevent fluid flow through the fluid passage 208. The hydraulic fuse 230 may be connected to and/or operatively coupled to the weak link coupling 210 such that, when the weak link coupling 210 disconnects, then the hydraulic fuse 230 may disconnect as well.

As shown in FIG. 2, one or more components may be positioned on and/or attached to the subsea skid 202. For example, the valve 218, the hydraulic actuator 220, and/or the accumulator 224 may be positioned upon the subsea skid 202. Further, in addition or in alternative, the valve 226, the valve 228, the valve 236, the pressure gauge 238, the pressure relief valve 240, the pressure compensator 242, and/or any combination of the above may be positioned upon the subsea skid 202. Further, those having ordinary skill in the art will appreciate that one or more components described above may be positioned on and/or attached to additional subsea skids such that multiple subsea skids may be used in accordance with the present disclosure.

Figure 3:
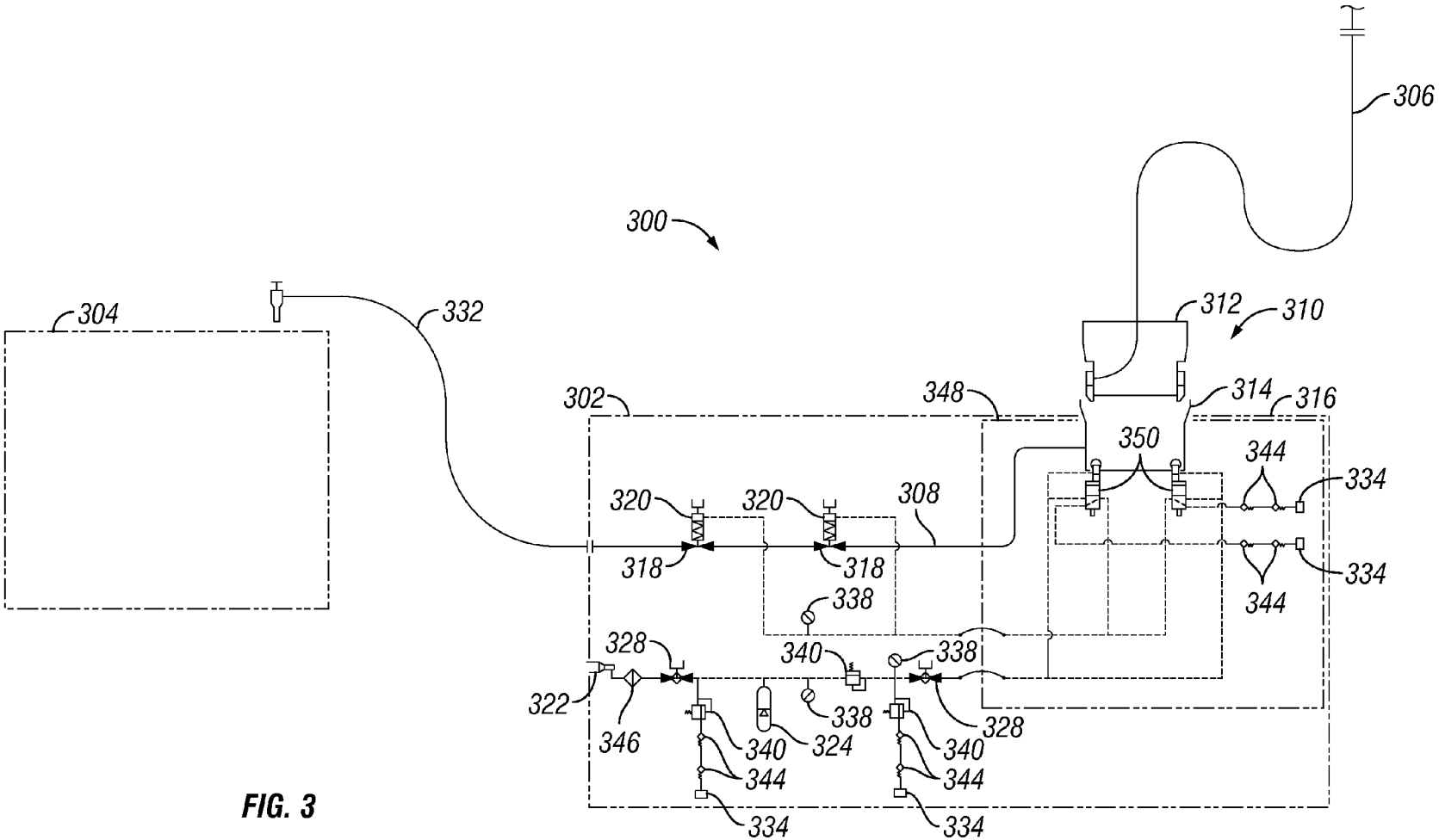
FIG. 3 shows a schematic view of a subsea well service system in accordance with one or more embodiments of the present disclosure.

Referring now to FIG. 3, a schematic view of a subsea well service system 300 in accordance with one or more embodiments of the present disclosure is shown. The system 300 may be similar to the systems 100 and 200 shown in FIGS. 1 and 2, and may include a subsea skid 302 operatively coupled and/or positioned between a surface vessel and a subsea tree 304 or manifold. A conduit 306 may extend from the surface vessel, into and through a fluid passage 308 of the subsea skid 302, and into a well through the subsea tree 304. Another conduit 332 may be used to fluidly couple the fluid passage 308 of the subsea skid 302 to the subsea tree 304. Fluid provided from the subsea vessel, through the conduit 306, may flow through a weak link coupling 310 and a flexible joint 316, and into the subsea skid 302. As discussed above, the weak link coupling 310 may include a male member 312 receivable within a female member 314 with a fluid passage extending therethrough. The coupling 310 may be designed such that the connection between the male member 312 and the female member 314 may be formed subsea and/or on the surface.

As with the above, the subsea skid 302 may be used to form a barrier between the conduit 306 and the subsea tree 304, such as by including one or more valves to selectively control fluid flow between the conduit 306 and the subsea tree 304. As such, the system 300 and/or the subsea skid 302 may include one or more valves 318 in this embodiment that may selectively control fluid flow through the fluid passage 308. The valves 318 may be hydraulically actuated using hydraulic actuators 320, each operatively coupled to a valve 318 to open and close the respective valve 318. Further, the valve 318 may be a fail-safe closed valve, such as biased towards the closed position, such that the valve 318 closes upon failure of or pressure loss within the hydraulic actuator 320 and/or the valve 318. The hydraulic actuator 320 may then actuate the valve 318 to move the valve to the open position and enable fluid flow through the fluid passage 308 when hydraulic pressure above a predetermined amount is received by the hydraulic actuator 130.

In this embodiment, the system 300 and/or the subsea skid 302 may include an inlet 322, one or more outlets 334, and/or an accumulator 324. The accumulator 324 may be in fluid communication between the inlet 322 and the hydraulic actuator 320 to accumulate and provide hydraulic pressure to the hydraulic actuator 320. The inlet 322 may be used to receive and provide hydraulic pressure to the subsea skid 302, such as to provide hydraulic pressure to the accumulator 324 and/or the hydraulic actuator 320 to open the valve 318. One or more of the outlets 334 may be used to vent hydraulic pressure from the hydraulic actuators 320 and/or the accumulator 324, such as to close the valve 318.

In this embodiment, one or more valves 350, such as directional control valves, may be included that may be engaged or indexed upon connection of the male member 312 with the female member 314 of the weak link coupling 310 to enable hydraulic pressure to be provided from the inlet 322 and/or the accumulator 324 to the hydraulic actuators 320 to open the valves 318. For example, one or more of the valves 318 may be opened upon connection of the male member 312 with the female member 314 such that the one or more valves 350 direct hydraulic pressure from the inlet 322 and/or the accumulator 324 to operate and actuate the hydraulic actuators 320. Upon disconnection of the male member 312 with the female member 314 of the weak link coupling 310, the valves 350 may direct hydraulic pressure from the hydraulic actuators 320 to the outlets 334, thereby enabling the valves 318 to close. As such, the valves 318 may open and enable fluid flow through the fluid passage 308 when the male member 312 and the female member 314 of the weak link coupling 310 are connected, and the valves 318 may close and prevent fluid flow through the fluid passage 308 when the male member 312 and the female member 314 of the weak link coupling 310 are disconnected.

Further, as shown, the system 300 and/or the subsea skid 302 may include more than one valve 350, such as to provide redundancy. For example, in the event that one of the valves 350 may fail, either in an open or closed configuration, the other of the valves 350 may be used to still operate the actuators 320. In one or more embodiments, both of the valves 350 may need to be indexed or engaged to open, such as to not vent and/or not direct hydraulic pressure from the hydraulic actuators 320 to the outlets 334, such that the valves 318 may be opened. In such an embodiment, in the event that one or both of the valves are indexed to close, such as to vent and/or direct hydraulic pressure from the hydraulic actuators 320 to the outlets 334, then the valves 318 may be or remain closed. Such an arrangement may limit the risk that one or more of the valves 350 may fail to leave one or more of the valves 318 open and compromise the integrity of the system 300.

The system 300 and/or the subsea skid 302 may include one or more valves 328 in fluid communication between the inlet 322 and the accumulator 324 and/or the hydraulic actuator 320 to selectively control the flow of hydraulic pressure therebetween. As shown, the valves 318 and/or the valves 328 may be controllable by an ROV.

Referring still to FIG. 3, the system 300 and/or the subsea skid 302 may include one or more pressure gauges 338, one or more pressure relief valves 340, one or more check valves 344, and/or one or more filters 346. The pressure gauges 338 may be in fluid communication with the hydraulic actuator 320 and/or the accumulator 324 to measure hydraulic pressure provided to the hydraulic actuator 320 and/or the accumulator 324. The pressure relief valves 340 may be in fluid communication with hydraulic actuator 320 and/or the accumulator 324 to relieve hydraulic pressure above a predetermined amount, such as to protect the hydraulic actuator 320, the accumulator 324, and/or other components from damage. The one or more check valves 344 may be positioned upstream of the one or more outlets 344, thereby enabling fluid to pass through and exit out of the system 300 and/or the subsea skid 302 through the outlets 334, but prevent fluid from entering through the outlets 334. Further, the filter 346 may be positioned downstream of the inlet 322 to filter fluid when providing hydraulic pressure into the system 300 and/or the subsea skid 302.

In one or more embodiments, as shown in FIG. 3, the system 300 and/or the subsea skid 302 may include a gimbal assembly 348, such as by having the gimbal assembly 348 connected between the coupling 310 and the subsea skid 302 and/or the coupling 310 included or positioned within the gimbal assembly 348. The gimbal assembly 348, which may also be a ball joint, flex joint, rotating joint, and/or articulating joint, may be used to reduce bending moments that would be applied to or received by the coupling 310 from the conduit 306. As such, the gimbal assembly 348 may enable the coupling 310 to rotate, pivot, move, and/or articulate about one or more different axes with respect to the subsea skid 302, in particular as tension and/or force may be applied to the coupling 310 through the conduit 306. This may enable the coupling 310 to have more repeatable and/or predictable behavior (e.g., consistent break-outs from force applied thereto) when in use.

Those having ordinary skill in the art will appreciate that, though only one fluid passage is shown as extending from the surface and through the subsea skid, the present disclosure is not so limited. For example, in one or more embodiments, additional fluid passages may be formed and/or included through the subsea skid. In such an embodiment, additional fluid passages may be used, such as to establish fluid communication, data, and/or confirmation of subsea operations behavior of the system and/or equipment in fluid communication with the system.

Whereas many alterations and modifications of the present invention will no doubt become apparent to a person of ordinary skill in the art after having read the foregoing description, it is to be understood that the particular embodiments shown and described by way of illustration are in no way intended to be considered limiting.

It is noted that the foregoing examples have been provided merely for the purpose of explanation and are in no way to be construed as limiting of the present invention. While the present invention has been described with reference to exemplary embodiments, it is understood that the words, which have been used herein, are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A subsea system to control fluid flow through a fluid passage, comprising:

a valve configured to selectively control fluid flow through the fluid passage;

a hydraulic actuator operatively coupled to the valve to open the valve when hydraulic pressure above a predetermined amount is received;

an inlet to provide the hydraulic pressure to the hydraulic actuator to open the valve;

an outlet to vent hydraulic pressure from the hydraulic actuator to close the valve;

a coupling comprising a male member and a female member that are disconnectable to prevent flow through the fluid passage; and wherein the hydraulic pressure is vented from the hydraulic actuator through the outlet to close the valve upon disconnection of the male member and the female member.

2. The system of claim 1, further comprising:

the fluid passage extending through the coupling;

wherein the male member and the female member are configured to disconnect to prevent flow through the fluid passage if force above a predetermined amount is received by the coupling;

and wherein the valve is fail-safe closed.

3. The system of claim 1, further comprising at least one of:

a hydraulic fuse operatively coupled to the coupling and in fluid communication with the outlet to vent hydraulic pressure from the hydraulic actuator and to close the valve upon disconnection of the male member and the female member of the coupling; and a second valve operatively coupled to the coupling and in fluid communication with the outlet to vent hydraulic pressure from the hydraulic actuator and to close the valve upon disconnection of the male member and the female member of the coupling.

4. The system of claim 3, wherein the hydraulic fuse comprises a hydraulic coupling to vent hydraulic pressure through the hydraulic coupling when the coupling is disconnected, and wherein the second valve comprises a directional control valve.

5. The system of claim 1, further comprising an accumulator in fluid communication with the hydraulic actuator to provide hydraulic pressure to the hydraulic actuator.

6. The system of claim 5, wherein the valve, the hydraulic actuator, and the accumulator are positioned on a subsea skid.

7. The system of claim 6, wherein the subsea skid is operatively coupled between a surface vessel and a subsea tree to inject fluid from the surface vessel through the fluid passage and into the subsea tree.

8. The system of claim 1, wherein the valve is independently controllable without any communication from a surface.

9. The system of claim 1, further comprising a flexible joint positioned and coupled between the coupling and a subsea skid, wherein the fluid passage extends through the flexible joint between the coupling and the valve.

10. The system of claim 1, wherein:

the fluid passage comprises coiled tubing;

the fluid comprises a chemical treatment to be injected within a well;

the coupling comprises a pressure balanced weak link coupling; and the outlet vents hydraulic pressure subsea.

11. The system of claim 1, further comprising a pressure relief valve in fluid communication with the hydraulic actuator to relieve hydraulic pressure above a second predetermined amount.

12. The system of claim 1, wherein the inlet comprises a hot stab to connect with a remotely operated vehicle, and wherein the valve is operable to open and close with the remotely operated vehicle.

13. The system of claim 1, further comprising a second valve to selectively control fluid flow through the fluid passage, wherein the second valve is operable to open and close with a remotely operated vehicle.

14. A subsea skid to service a well, comprising:

a valve configured to selectively control fluid flow through a fluid passage;

a hydraulic actuator operatively coupled to the valve to open the valve when hydraulic pressure above a predetermined amount is received;

a coupling comprising a male member and a female member with the fluid passage extending therethrough;

wherein the male member and the female member of the coupling are configured to disconnect to prevent flow through the fluid passage if force above a predetermined amount is received by the coupling; and wherein hydraulic pressure is configured to be vented from the hydraulic actuator to close the valve upon disconnection of the male member and the female member of the coupling.

15. The subsea skid of claim 14, further comprising:

an inlet to provide hydraulic pressure to the hydraulic actuator and open the valve; and an outlet to vent hydraulic pressure from the hydraulic actuator and close the valve.

16. The subsea skid of claim 15, further comprising at least one of:

a hydraulic fuse operatively coupled to the coupling and in fluid communication with the outlet to vent hydraulic pressure from the hydraulic actuator and to close the valve upon disconnection of the male member and the female member of the coupling; and a second operatively coupled to the coupling and in fluid communication with the outlet to vent hydraulic pressure from the hydraulic actuator and to close the valve upon disconnection of the male member and the female member of the coupling.

17. The subsea skid of claim 14, further comprising an accumulator in fluid communication with the hydraulic actuator and configured to provide hydraulic pressure to the hydraulic actuator, and wherein the valve is fail-safe closed.

18. The subsea skid of claim 14, further comprising a flexible joint with the coupling connected to the flexible joint and the fluid passage extended through the flexible joint between the coupling and the valve.

19. A method of operating a subsea system, comprising:

providing fluid from a surface vessel through a coupling comprising a fluid passage and into a subsea tree;

disconnecting a male member from a female member of the coupling upon receiving force above a predetermined amount by the coupling; and venting hydraulic pressure from a hydraulic actuator upon disconnection of the male member and the female member of the coupling, thereby closing a valve operatively coupled to the hydraulic actuator to prevent fluid flow through the fluid passage with the valve.

20. The method of claim 19, further comprising:

injecting hydraulic pressure into an accumulator in fluid communication with the hydraulic actuator to provide hydraulic pressure to the hydraulic actuator, thereby opening the valve to enable fluid flow through the fluid passage with the valve;

wherein at least one of a hydraulic fuse and a second valve is in fluid communication with the hydraulic actuator to vent hydraulic pressure from the hydraulic actuator; and wherein the valve is fail-safe closed.

* * * * *